United States Patent [19]

Gilcher

[11] 4,298,179

[45] Nov. 3, 1981

[54] VITAL CROSS FIELD TRANSFORMER CIRCUIT ARRANGEMENT FOR RAILROAD SIGNALING SYSTEMS

[75] Inventor: Heinz Gilcher, Export, Pa.

[73] Assignee: American Standard Inc., Swissvale, Pa.

[21] Appl. No.: 44,124

[22] Filed: May 31, 1979

[51] Int. Cl.[3] ..... B61L 21/06

[52] U.S. Cl. ..... 246/34 R; 246/34 D; 307/514

[58] Field of Search ..... 246/34 R, 34 CT, 34 D, 246/28 K; 307/232; 329/50; 336/212, 214, 215; 323/89 P, 89 C, 76

[56] References Cited

U.S. PATENT DOCUMENTS

| | | | |
|---|---|---|---|
| 1,910,381 | 5/1933 | Dowling | 246/34 D |
| 2,911,586 | 11/1959 | Zelina | 336/212 X |
| 3,183,432 | 5/1965 | Pintell | 323/76 X |
| 3,970,271 | 7/1976 | Aver et al. | 246/34 R |
| 4,118,750 | 10/1978 | Auer, Jr. et al. | 246/34 CT X |

*Primary Examiner*—J. D. Miller
*Assistant Examiner*—Reinhard J. Eisenzopf
*Attorney, Agent, or Firm*—A. G. Williamson, Jr.

[57] ABSTRACT

A cross field transformer circuit arrangement for use as a solid-state, synchronous detector track relay device for alternating current track circuits. The track signal at the receiver end is applied to the primary winding on the main magnetic circuit and the local input signal to another primary winding on the modulating magnetic circuit of the saturable core of the transformer. Each input is transformer isolated from its source and passed through a noise-rejecting filter tuned to track circuit frequency. The main magnetic circuit flux is modulated by the modulating magnetic circuit cross field flux so that the secondary winding, on the main magnetic circuit, produces an output signal at double the track frequency, i.e., its second harmonic. A band pass output filter passes only this second harmonic signal to a full-wave rectifier to energize a biased track relay only when both inputs, in phase and of the same frequency, are received. For track circuit use, a diode added in series with the local input filter and a second diode inserted in series with the secondary output modify circuit operation to inhibit response by a two-winding, biased track relay to an opposite polarity track input signal received through a failed insulated joint.

9 Claims, 11 Drawing Figures

VITAL CROSS FIELD TRANSFORMER CIRCUIT ARRANGEMENT FOR RAILROAD SIGNALING SYSTEMS

RELATED APPLICATIONS

1. Ser. No. 953,526, filed Oct. 23, 1978, by R. D. Campbell and John O. G. Darrow for a Fail-Safe Product Detector Using Hall Effect Device, now abandoned.

2. Ser. No. 953,527, filed Oct. 23, 1978, by Heinz Gilcher for a Vital Power Varistor Circuit for Railroad Signaling Systems, now U.S. Pat. No. 4,188,002, issued Feb. 12, 1980.

3. Ser. No. 92,006, filed Nov. 7, 1979, which is a continuation of now abandoned Ser. No. 953,528, filed Oct. 23, 1978, by Heinz Gilcher for a Vital Optical Coupler Circuit Arrangement for Railroad Signaling Systems.

BACKGROUND OF THE INVENTION

My invention relates to a cross field transformer circuit arrangement for use in railroad signaling systems. More specifically, the invention pertains to a cross field transformer circuit arrangement usable as a substitute for a conventional track relay in an alternating current track circuit for electrified railroads.

In at least one large electrified railroad installation, a signaling system using 100 Hz alternating current (A.C.) track circuits has been in use for many years. These track circuits are based on the use of track relays of the centrifugal motor type to register the occupancy condition of the track section. Such relays are essentially synchronous detectors and are designed to be immune from operation by currents at the 25 Hz propulsion frequency presently in use on this specific electrified railroad. For several reasons, the propulsion power on this and other railroads is to be changed to 60 Hz frequency. Such change-over will allow the use of the commercial power sources at a higher voltage and will eliminate the need for separate, self-owned generating stations. At the same time, it is impractical and uneconomical to change the 100 Hz track circuits to a different, i.e., higher, frequency. The centrifugal track relays have a limited frequency immunity characteristic and thus cannot be used if the propulsion frequency is shifted to 60 Hz. Therefore, in order to continue the use of 100 Hz track circuits in the signaling systems, an economic replacement for the present centrifugal type track relay is needed which has sufficient immunity to inhibit operation by currents at the 60 Hz propulsion frequency. Further, the centrifugal relays have always required considerable preventative maintenance to assure reliable operation. Thus, a nonactive, solid-state arrangement, without moving parts, to replace these relays is also desirable in order to reduce maintenance and servicing costs.

Accordingly, an object of my invention is a vital circuit arrangement incorporating a cross field transformer for use as the train detector in alternating current track circuits.

Another object of the invention is a solid-state circuit arrangement using a cross field transformer to replace the centrifugal track relay in alternating current track circuits in electrified railroads.

A further object of my invention is a solid-state, synchronous detector responsive to dual inputs having proper relationship to detect the presence of a selected input only if both are present.

A still further object of the invention is an alternating current track circuit for electrified railroads using a dual input, vital cross field transformer circuit arrangement to detect the trains in each track section.

It is also an object of my invention to provide a synchronous detector circuit using a passive cross field transformer network to replace centrifugal track relays in alternating current track circuits.

Yet another object of the invention is a vital, solid-state arrangement for alternating current track circuits in electrified railroads incorporating a cross field transformer with one input signal received through the track rails from a selected energy source and a second local input received directly from the same source for providing an output signal to a register relay only when both inputs are received and have a predetermined phase relationship.

Other objects, features, and advantages of my invention will become apparent from the appended claims when taken in connection with the accompanying drawings.

SUMMARY OF THE INVENTION

According to the invention, a solid-state, synchronous detector is provided based on a cross field transformer having a saturable core structure including main and modulating magnetic circuits. The first primary winding is mounted on the modulating portion of the core while a second primary winding and the output or secondary winding are wound on the main portion of the core. Simultaneous inputs to both primary windings of inphase signals having the same frequency result in an output from the secondary winding having second harmonic characteristics, i.e., double the input frequency. The secondary output is passed through a band pass filter path which blocks other than the second harmonic signals. The passed signal is rectified and energizes a vital biased relay. The energized condition of the relay registers the input of both signals and specifically that the second primary input is present.

Specifically, the arrangement is shown used as a track relay means in alternating current track circuits for electrified railroads. The local source of track circuit energy is coupled to the first primary winding on the modulating core through an isolating transformer. A noise-rejecting, series filter path, tuned to the track circuit frequency, is inserted in the connections from the isolating transformer secondary to the first primary winding of the cross field transformer. A second input signal is provided from the track rails at the receiver end of the associated track section, as transmitted from the track circuit source connected at the other end of that section. This second energy source is coupled to the second primary winding of the cross field transformer through a saturable isolating transformer, which steps up the track signal voltage level, and another similarly tuned noise-rejecting LC filter path. The output of the cross field transformer from the secondary winding, which has double the track circuit frequency, is connected through a band pass LC filter, tuned to this second harmonic frequency, to a rectifier whose output supplies the track relay which is of the biased, direct current type. Illustrated modifications of the local input and the output circuit connections provide additional protection against insulated joint breakdown between adjacent track sections.

BRIEF DESCRIPTION OF THE DRAWINGS

Prior to defining the invention in the appended claims, I shall describe a specific arrangement embodying the invention and illustrated in the accompanying drawings, in which:

In each of the drawings, similar references designate similar parts or functions of the illustrated apparatus.

DESCRIPTION OF THE ILLUSTRATED EMBODIMENT

Figure 1A:
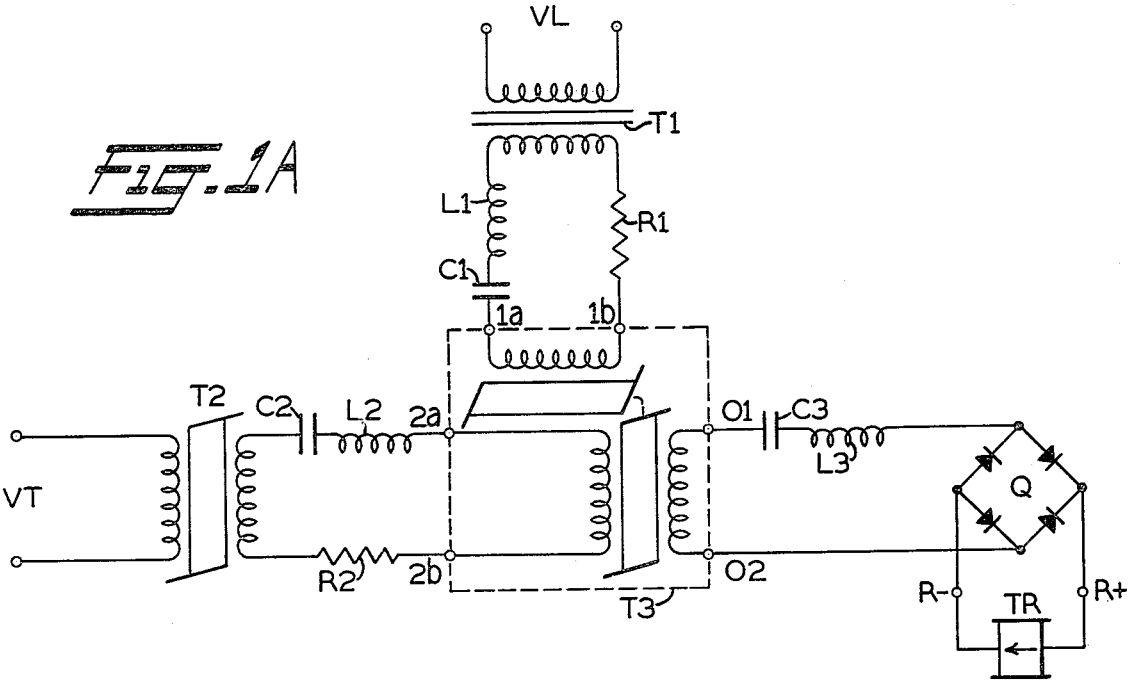
FIG. 1A is a diagrammatic illustration of a vital, cross field transformer circuit arrangement for detecting the presence or absence of dual input signals and embodying my invention.
Figure 2:
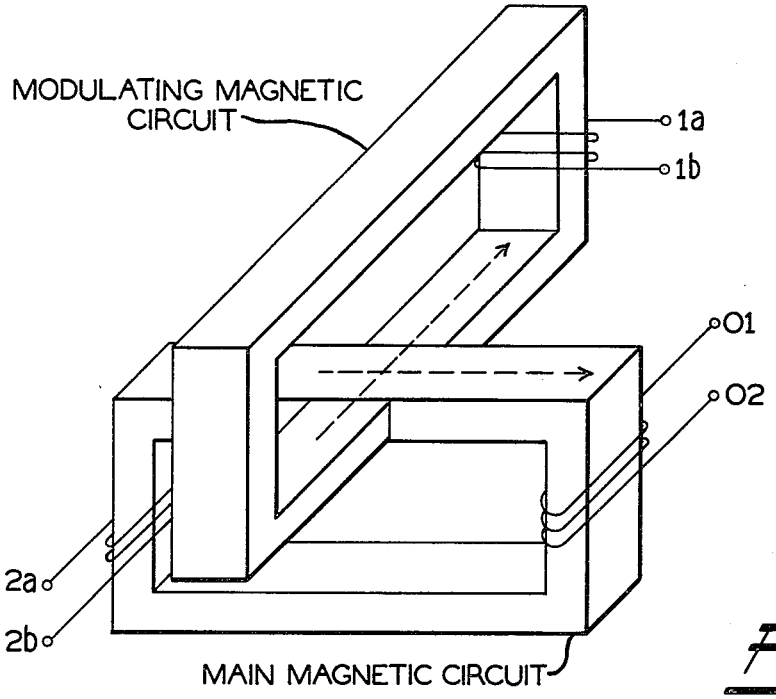
FIG. 2 is a schematic diagram of one form of cross field transformer core and winding arrangement usable in the FIG. 1A circuit arrangement.
Figure 3:
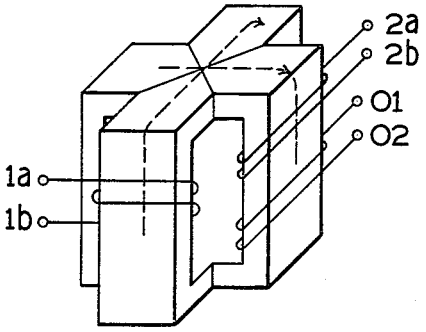
FIG. 3 is a schematic diagram of a second form of cross field transformer core and winding arrangement also usable in FIG. 1A circuits.
Figure 4:
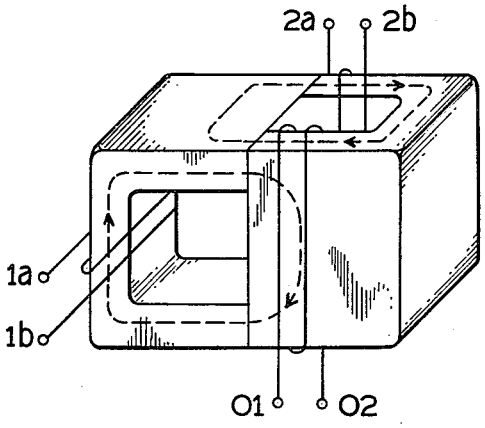
FIG. 4 is a schematic diagram of a third form of a core and winding arrangement for a cross field transformer also usable in the FIG. 1A circuit arrangement.

Referring first to FIG. 1A, a basic circuit arrangement embodying the invention is illustrated for the initial explanation. The cross field transformer which is the basis for the circuit arrangement is schematically shown within the dashed block T3 at the center of the circuit illustration. A first primary winding of this transformer is connected between the input terminals *1a* and *1b*. A second primary winding is connected between the input terminals *2a* and *2b* while the secondary or output winding is connected to terminals 01 and 02. These various windings are coupled by a saturable type core which is designated by conventional symbols for such core structure. Three possible physical arrangements of the core and winding structures are shown in FIGS. 2, 3, and 4. As shown specifically in FIG. 2, the second primary and the secondary windings are wound on and directly coupled by a main magnetic circuit of the transformer. The first primary winding is wound on a modulating magnetic circuit. In each of the three illustrated structures, the windings have the same relationship. On the schematic drawings, dashed lines on each core structure illustrate the flux paths produced by the first and second primary on the modulating and main core structures, respectively. The crossing flux generated in the modulating magnetic circuit by energy in the first primary winding modulates the permeability of the main magnetic circuit by rotating the magnetic domains in the common magnetic zone. This action results in an amplitude modulated signal being induced in the output or secondary winding of the cross field transformer.

Referring again to FIG. 1A, the source VL at the top is a local alternating current source with a preselected frequency, e.g., 100 Hz, which supplies an input to the primary winding of isolation transformer T1. The output from the secondary of transformer T1 is fed to a series-tuned, noise-rejecting filter comprising capacitor C1, inductor L1, and total loop resistance R1. This filter path is, of course, tuned to the preselected frequency of source VL. The filtered signal is then supplied through terminals *1a* and *1b* to the first primary winding of the cross field transformer T3. A second source VT has the same frequency as source VL and is supplied from the same basic energy source, but is received over a transmission line with variable characteristics and conditions. Source VT supplies the input to a saturable transformer T2 which steps up the low level input signal received over the transmission channel, acts as an amplitude limiter, and isolates the circuit input. The output from the secondary of transformer T2 is fed through a series-tuned, noise-rejecting filter comprised of capacitor C2, inductor L2, and total loop resistance R2. This filter path is also tuned to the source frequency and the filtered signal is connected across the second primary winding of transformer T3 through input terminals *2a* and *2b*.

When the local (VL) and transmitted (VT) input signals, of the same frequency and in phase, feed into the cross field transformer primary windings, the modulation of the main magnetic circuit flux by that in the modulating magnetic circuit produces a second harmonic or double frequency signal at the output terminals of the secondary winding of transformer T3. For example, if the preselected frequency of sources VL and VT is 100 Hz, the frequency of the output signal at output terminals O1 and O2 is 200 Hz. To prevent energy at other frequencies, resulting from the mixing of induced signals with the preselected frequency input signals, from passing into the load, a series-tuned band pass filter comprising capacitor C3 and inductor L3 is connected in series with the output of transformer T3. In the specific example, this LC filter network is tuned at 200 Hz. The filtered output is connected to a full-wave rectifier Q which supplies its rectified output with proper polarity to a biased, direct current vital relay TR, which is energized and picks up only when a sufficient output signal at the double frequency is supplied from the secondary of transformer T3.

Figure 1B:
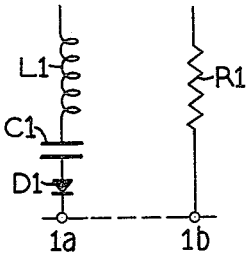
FIG. 1B is a modification of the first input circuit network of the FIG. 1A arrangement used when the apparatus is incorporated in an alternating current track circuit.
Figure 1C:
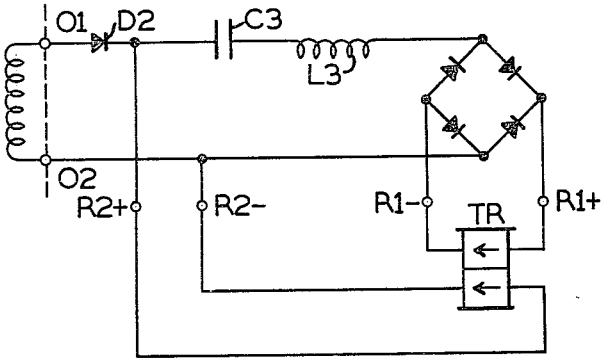
FIG. 1C is a modification of the output network of the FIG. 1A arrangement incorporating a two-winding, biased relay, which is used when the arrangement is part of a track circuit.
Figure 7:
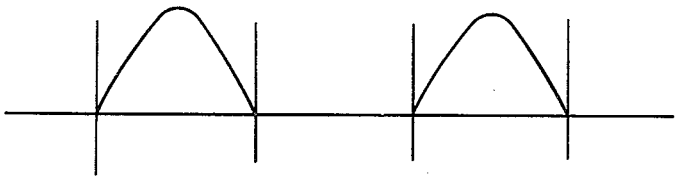
FIG. 7 is another chart showing the local input signal wave-form for a circuit arrangement illustrated by the FIG. 1B modification.
Figures 1, 9:
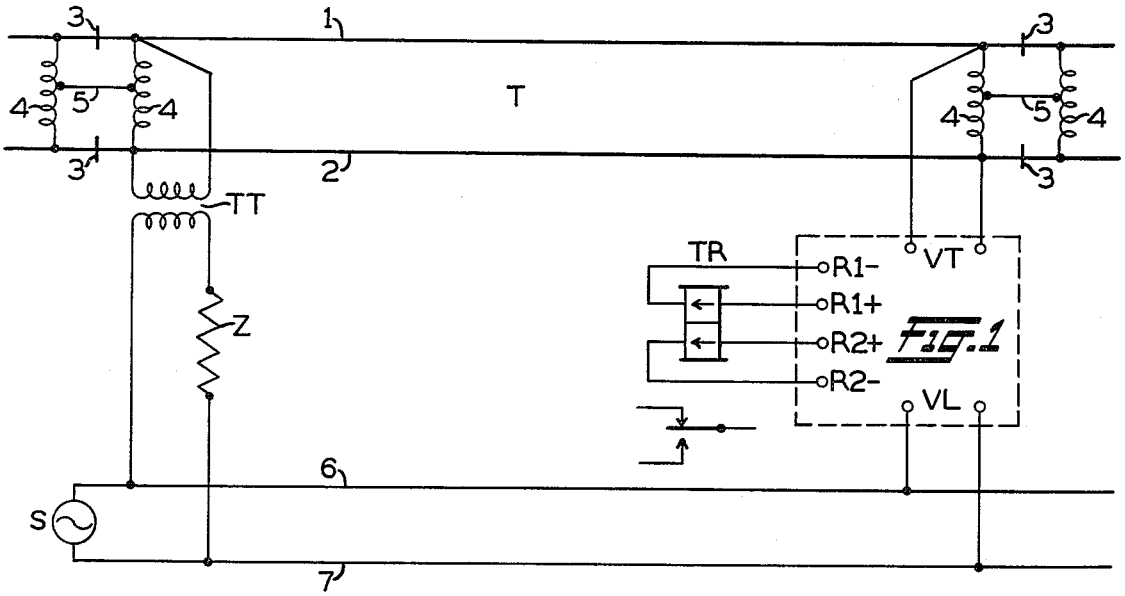
FIG. 9 is a schematic diagram of an alternating current track circuit using the vital circuit arrangement of FIG. 1A as modified by the illustrations of FIGS. 1B and 1C.

A principal intended use for the circuit arrangement of FIG. 1A is as a solid-state track relay device in an alternating current track circuit in electrified railroads, as is typically shown in FIG. 9. However, in order to provide broken down insulated joint protection, some modification of the circuitry is required to prevent pickup of relay TR when the input signal VT, i.e., the track input, is 180° out-of-phase with the local signal VL. This phase difference occurs since the source connections to adjoining track circuits are of reversed polarity. The first modification is shown in FIG. 1B and consists of inserting a diode D1 in series with the filter network coupling the secondary of transformer T1 to the input terminals 1*a* and 1*b* of transformer T3. This allows the application of only the positive half cycles of the input signal VL, as shown in FIG. 7, to the first or modulating primary winding of transformer T3. A second modification is made in the transformer T3 output circuits as shown in FIG. 1C. A diode D2 is inserted between output terminals O1 and O2 and the capacitor C3, inductor L3 network. Further, a two-winding, biased, direct current relay is used for track relay TR. The first or upper winding of this relay is connected to receive energy through the band pass filter and full-wave rectifier Q at terminals R1+ and R1−. Except for diode D2, this is the same circuitry which supplies the single winding of relay TR in the FIG. 1A arrangement. However, the second winding of relay TR is connected at terminals R2+ and R2− to receive energy direct from the secondary winding of transformer T3 through diode D2. It is to be noted that, in FIG. 1C, both windings of relay TR must be sufficiently energized at the proper polarity for the relay to operate, that is, pick up to close front contacts.

Referring now to FIG. 9, a track section T is shown which is part of an electrified railroad having a propulsion power source of either 25 or 60 Hz. Section T includes two rails 1 and 2 which are electrically isolated from rails of the adjoining track sections by the insulated joints 3. Because the rails provide the propulsion return circuit path, impedance bonds are provided at each insulated joint location between the adjacent track sections. For example, a bond winding 4 is connected across rails 1 and 2 on each side of each pair of insulated joints dividing the track section rails, with the center taps of associated windings connected by a conductor lead 5. Energy for the track circuits is supplied from an alternating current source S, shown at the left by conventional symbol, having a preselected frequency, e.g., 100 Hz in at least one large system, as previously mentioned. Energy from source S is transmitted along the stretch of track by line wires 6 and 7. The track rails of section T are supplied with energy through a track transformer TT, the primary winding of which is connected across lines 6 and 7 and the secondary winding across rails 1 and 2 at the left or transmitter end of section T. Rails 1 and 2 thus become the transmission line or channel over which the input signal VT is transmitted for application to the arrangement of FIG. 1A. The leads to the primary of transformer TT include an impedance Z used for limiting the track current under train shunt conditions. Impedance Z may also be used to adjust the phase angle of the track current with relation to source S. It is noted that transformer TT may be combined with the associated impedance bond 4, but is preferably separate as illustrated here.

At the other or receiving end of section T, a circuit arrangement of FIG. 1A, modified as illustrated in FIGS. 1B and 1C, is connected to receive energy from the line wires and the rails. This circuit arrangement is conventionally illustrated here by the dashed line block with terminals designated in accordance with FIG. 1A except that two sets of output terminals R are illustrated for connection to two windings of the biased track relay TR, as in FIG. 1C. Terminals VL are connected across line wires 6 and 7 to receive local energy direct from source S. Terminals VT are connected across rails 1 and 2, at the right-hand bond winding 4, to receive energy through the transmission channel provided by rails 1 and 2, but originating from the same source S. Relay TR is used to register the track occupancy condition of section T, with the illustrated transfer contact of this relay picked up to close the front contact when the section is unoccupied. Relay TR releases and closes the back contact when the section is occupied or a fault occurs in any of the apparatus. Normally, relay TR will release because track signal VT is not received due to a train shunt across rails 1 and 2. It may be noted that the band pass filter made up of capacitor C3 and inductor L3 is principally to block the propulsion frequency or mixes of the propulsion, track, and other induced frequencies from feeding into the track relay load.

Figure 5:
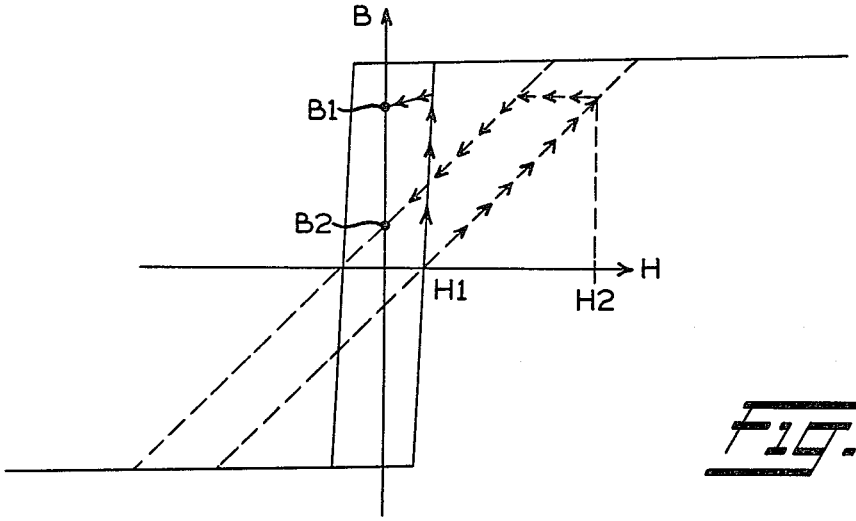
FIG. 5 is a conventional graph showing the magnetic hysteresis curves for the core of a cross field transformer under various conditions in the circuit arrangement of FIG. 1A.

In FIG. 5, a normal B-H curve for magnetic circuits, such as provided by the main core of transformer T3, is shown by the solid line curve. With the addition of an air gap in the magnetic circuit, a new B-H curve of the combined air and iron paths is shown by the dashed line curve in FIG. 5. This latter curve represents the characteristics the modulating magnetic circuit of transformer T3 should have. When diode D1 is added in the local input coupling circuit, as shown in FIG. 1B, the signal at input terminals 1*a* and 1*b* of transformer T3 is as shown in FIG. 7, that is, only the positive half cycles of the 100 Hz signal input are applied. This results in a B-H excursion in transformer T3 which follows the arrowheads on the dashed curve of FIG. 5. It may be noted that the residual flux density, point B2, is relatively low when the field strength H is zero. The arrows on the solid line curve represent the B-H excursion under equivalent input conditions, and the higher residual flux density, point B1, when no air gap is provided in the magnetic circuit.

Figure 6:
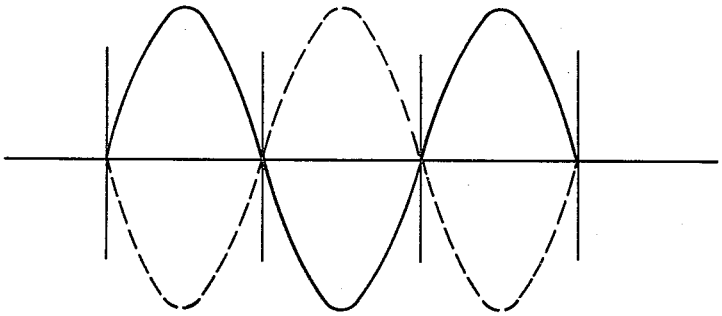
FIG. 6 is a chart showing the track input signal waveforms for the FIG. 1 circuit arrangements.
Figure 8:
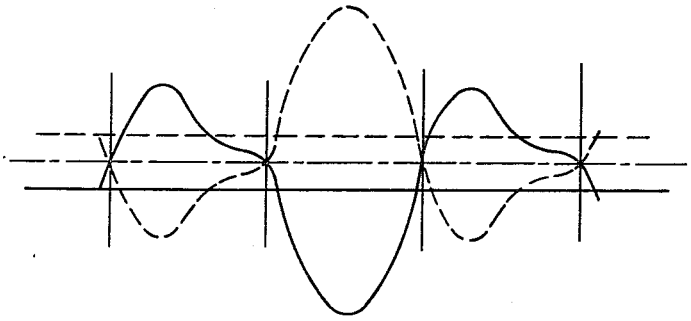
FIG. 8 is a chart illustrating the output wave-forms from the cross field transformer secondary winding under various input conditions.

The normal track signal input VT at terminals 2*a* and 2*b* of transformer T3 is illustrated by the solid curve of FIG. 6. With this input and the local input VL, as in FIG. 7, the resulting output signal of transformer T3, at terminals O1 and O2, is shown by the solid curve of FIG. 8. Under normal conditions of the track and local signals, the use of diode D1 in the local input network causes the effective zero amplitude level of this solid curve to shift to the level of the solid horizontal line in FIG. 8, which is below the expected or actual zero shown by the dot-dash line. The effect is to equalize the area (energy) between the shifted zero line and the positive and negative portions of the wave-form of a complete cycle. It is to be noted that the positive portion, i.e., above the shifted zero level, contains second harmonic modulations while the negative portion remains harmonic-free. In the modified output arrangement of FIG. 1C, diode D2 permits only conduction of the positive half cycle signals containing the second or 200 Hz harmonic. The band pass filter provided by capacitor C3 and inductor L3 permits only the transmission of this 200 Hz signal to the full-wave rectifier Q. The direct current pulses at the output of diode D2 are connected to the lower coil of the biased relay TR. In order to pick up, this relay requires direct current energy on the upper coil produced from the 200 Hz harmonic through rectifier Q plus the aiding, direct current energy in the lower coil. In other words, both signal VL and VT must be received at the proper levels and in proper phase relationship for relay TR to pick up to indicate an unoccupied track section T.

If an insulated joint between section T and the section to the immediate right fails, the track input signal VT may be shifted 180° out-of-phase with the local signal VL, as illustrated by the dashed wave-form curve in FIG. 6, due to the feed-through from the adjacent section transmitter source. This condition may occur even with a train occupying section T. Without the predetermined precautions, that is, with the FIG. 1A circuit arrangement only, it is possible that relay TR will remain picked up. However, with the circuit modifications provided by the arrangements of FIGS. 1B and 1C, the output signal of transformer T3 will then have the wave-form of the dashed curve of FIG. 8. Because of diode D1, the effective zero line is now shifted to the horizontal dashed line above the dot-dash base line in FIG. 8. Under these conditions, the signal passed by diode D2 contains no 200 Hz component. Since the band pass filter C3-L3 blocks all portions of the signal, at other frequencies, no energy is supplied into rectifier Q so that the upper winding of relay TR is not energized. Relay TR will thus not pick or will release if already picked up since both windings must be energized to register an unoccupied track section. It is also obvious that, when the track signal VT is shunted away by the train occupancy, there is no input to transformer T3 to be modulated by the local signal VL input. Again, there is no 200 Hz component to be passed by the output filter path and relay TR is de-energized and releases to register the track occupied condition.

The disclosed circuit arrangement thus acts or operates as a two-element, alternating current track relay device. As such, it has vital characteristics since shorting or opening of a circuit component results in the release of relay TR. Specifically, if diode D1 shorts, the output signal from transformer T3 contains a 200 Hz component in both the positive and negative half cycles. The resulting direct current pulses supplied directly to the lower winding of the relay from diode D2 are thus greatly reduced in energy level, causing the relay to release. If diode D2 shorts, the lower winding receives an alternating current signal which also causes relay TR to release. The relay device also rejects large undesired signals at propulsion frequencies and its various harmonics so that an unoccupied track section cannot be be registered if only such signals are input into the relay device arrangement.

The circuit arrangement of the invention thus provides an alternative or replacement for the centrifugal type track relay for alternating current track circuits which is of solid-state construction and includes only passive elements. In other words, there are no moving parts requiring periodic maintenance nor are there any active electronic circuits. The device may be used with the existing track circuit frequencies and will provide immunity from the present 25 Hz or the proposed 60 Hz propulsion power frequencies. The arrangement will work over a wide range of track ballast conditions, yet protects against improper operation if an insulated joint failure occurs between adjoining track sections. There is isolation between the local and track circuit portions and the arrangement will reject large signals of the traction frequency or its harmonics. All this is accomplished in an efficient and economical manner to allow substitution into existing track circuits and yet retain the present operating frequency.

Although I have herein shown and described but one form of the vital cross field transformer circuit arrangement embodying my invention, with two necessary modifications, it is to be understood that other changes and modifications within the scope of the appended claims may be made without departing from the spirit and scope of the invention.

Having now described the invention, what I claim as new and desire to secure by Letters Patent, is:

1. A vital cross field transformer circuit arrangement, for registering the presence or absence of a selected one of two input signals, comprising, (a) a cross field transformer with interrelated main and modulating magnetic circuits, a primary winding wound on each magnetic circuit, and a secondary winding wound on said main magnetic circuit, (b) a first input means coupling the modulating primary winding to a first source of alternating current signals of a preselected frequency and operable for supplying only signals of said preselected frequency to the associated winding, (c) a second input means coupling the main primary winding to a second source of alternating current signals of said preselected frequency and within a predetermined phase relationship to said first source signals, (1) said second input means operable for supplying only signals of said preselected frequency to said main primary winding, (d) said cross field transformer responsive to said signals from said first and second input means for producing secondary winding output signals of double said preselected frequency only when both input signals are present and within said predetermined phase relationship, (e) a registry means normally occupying a first condition and operable to a second condition, and (f) output means coupled to said secondary winding and responsive only to signals of double said preselected frequency for operating said registry means to its second condition to register the presence of said second source signals.

2. A cross field transformer circuit arrangement, as defined in claim 1, in which, (a) said second source is a transmission channel connected to said first source at a remote location for supplying signals at said preselected frequency to said second input means, (b) the presence and absence of signals from said second source represent first and second conditions of said channel to be registered, and (c) said registry means occupies its first condition for registering said second channel condition and occupies its second condition for registering said first channel condition.

3. A circuit arrangement, as defined in claim 2, in which each input means includes, (a) an isolation transformer connected to couple the associated source to the corresponding cross field transformer primary winding, and (b) a tuned filter path connected for supplying only signals of said preselected frequency from the associated isolation transformer to the corresponding primary winding.

4. A circuit arrangement, as defined in claim 3, in which, (a) said registry means is a biased, direct current relay normally occupying a first position and operable to a second position when energized with preselected polarity to register the presence of said second source signals, and (b) said output means includes, (1) a band pass filter path tuned to said double frequency, and (2) a rectifier means coupled to said secondary winding by said band pass filter path for supplying an energizing signal of said preselected polarity to said relay only when said secondary output is of said double frequency.

5. A circuit arrangement, as defined in claim 3, in which, (a) said registry means is a two-winding, biased direct current relay normally occupying a first position and operable to a second position to register the presence of said second source signals only when both windings are energized at a preselected polarity, (b) said output means includes, (1) a band pass filter path tuned to said double frequency, and (2) a rectifier means coupled to said secondary winding by said band pass filter path for supplying an energizing signal of said preselected polarity to a first winding of said relay only when a signal of said double frequency is passed by said band pass filter path, and which further includes, (c) a first diode connected in series with the filter path of said first input means for limiting the signal applied to said modulating primary winding to selected half cycles of said first source signals, and (d) a second diode connected in series with said secondary winding for supplying a selected portion of the secondary output to said band pass filter and an energizing signal of said preselected polarity to the second winding of said relay, (e) said cross field transformer being responsive to half cycle input to said modulating primary winding for producing a secondary winding output signal with said double frequency component in said selected portion supplied by said second diode only when the input signals from said first and second sources are substantially in phase.

6. A circuit arrangement, as defined in claim 4 or 5, in which, (a) said transmission channel is the track rail portion of an insulated railroad track circuit supplied with energy at a remote transmitter end of the corresponding track section from a track circuit source having said preselected frequency, (b) said isolation transformer of said first input means is connected direct to said track circuit source, and (c) said first and second channel conditions represent section occupied and unoccupied conditions, respectively.

7. A vital track circuit arrangement, for an insulated track section of an electrified railroad with an alternating current propulsion power source of a first frequency and having a return path through the rails, comprising in combination, (a) another source of alternating current energy of a second frequency coupled to the section rails at the transmitting end, (b) a cross field transformer with main and modulating magnetic circuits, a primary winding wound on each magnetic circuit, and a secondary winding wound on said main magnetic circuit, (c) a first input means coupling said modulating primary winding to said other source for receiving only signals at said second frequency, (d) a second input means coupling said main primary winding to said section rails at the other end for receiving signals only of said second frequency from said other source through said rails when the section is unoccupied, (e) said cross field transformer responsive only to the simultaneous reception within a predetermined phase relationship of both signals of said second frequency for producing an output signal in said secondary winding having double said second frequency, and (f) output means coupled to said secondary winding and responsive only to output signals of double said second frequency for registering an unoccupied track section condition.

8. A track circuit arrangement, as defined in claim 7, in which said output means comprises, (a) a band pass filter path tuned to double said second frequency, (b) a rectifier means coupled to said secondary winding by said band pass filter for producing a direct current output signal only when a double frequency output signal is present at said secondary winding, and (c) a biased, direct current relay normally occupying a first position for registering an occupied track section and operable to a second position when energized with a preselected polarity for registering an unoccupied track section, (d) said relay connected to said rectifier means for receiving energy at said preselected polarity when said rectifier means produces an output signal.

9. A track circuit arrangement, as defined in claim 8, in which, (a) said first input means includes, (1) a first filter circuit path tuned to said second frequency, (2) a first diode connecting said first filter circuit path to said modulating primary winding, and (3) a first isolation transformer coupling said first filter path and first diode network to said other source for supplying only selected half cycles of said second frequency signals as input to said modulating primary winding, (b) said second input means includes, (1) a second filter circuit path tuned to said second frequency and connected to said main primary winding, and (2) a second saturable isolation transformer coupling said second filter path to said rails at said other end for supplying only second frequency signals received through said rails as input to said main primary winding, (c) said cross field transformer is responsive to both input signals for producing an output signal from said secondary winding having a double said second frequency component only in alternate half cycles, (d) said biased relay has two windings, with a first winding connected to said rectifier means, and is operable to its second position, for registering an unoccupied section, only when both windings are energized at said preselected polarity, and which further includes, (e) a second diode connected in series with said secondary winding for passing a selected portion of said secondary output signal to said band pass filter path, (f) said second diode also coupled for supplying said selected portion to the second winding of said relay at said preselected polarity, (g) said secondary output including said double frequency component in said selected portion passed by said second diode only if said source and track input signals are substantially in phase.

* * * * *